US011219265B2

(12) United States Patent
Pfanner

(10) Patent No.: US 11,219,265 B2
(45) Date of Patent: Jan. 11, 2022

(54) VISOR AND COMBINATION THEREOF WITH A PROTECTIVE HELMET

(71) Applicant: Pfanner Schutzbekleidung GmbH, Koblach (AT)

(72) Inventor: Anton Pfanner, Hohenems (AT)

(73) Assignee: PFANNER SCHUTZBEKLEIDUNG GMBH, Koblach (AT)

( * ) Notice: Subject to any disclaimer, the term of this patent is extended or adjusted under 35 U.S.C. 154(b) by 25 days.

(21) Appl. No.: 16/372,403

(22) Filed: Apr. 2, 2019

(65) Prior Publication Data

US 2019/0223537 A1 Jul. 25, 2019

Related U.S. Application Data

(63) Continuation of application No. 14/417,246, filed as application No. PCT/EP2013/065447 on Jul. 22, 2013, now abandoned.

(30) Foreign Application Priority Data

Jul. 27, 2012 (DE) ..... 102012015023.7

(51) Int. Cl.
*A42B 3/22* (2006.01)

(52) U.S. Cl.
CPC ..... *A42B 3/222* (2013.01); *A42B 3/225* (2013.01)

(58) Field of Classification Search
CPC ..... A42B 3/222; A42B 3/225
USPC ..... 2/424
See application file for complete search history.

(56) References Cited

U.S. PATENT DOCUMENTS

| | | | |
|---|---|---|---|
| 4,067,065 | A | 1/1978 | Slosek |
| 4,070,712 | A | 1/1978 | v. d. Marwitz |
| 4,397,047 | A | 8/1983 | Nava |
| 4,621,377 | A | 11/1986 | Pennell |
| 4,766,609 | A | 8/1988 | Lane |
| 4,794,652 | A | 1/1989 | Piech von Planta et al. |

(Continued)

FOREIGN PATENT DOCUMENTS

| | | |
|---|---|---|
| AT | 8206 | 4/2006 |
| CA | 1127801 A1 | 7/1982 |

(Continued)

OTHER PUBLICATIONS

International Search Report and Written Opinion dated Oct. 9, 2013 from the corresponding PCT/EP2013/065447.
File history of related U.S. Appl. No. 14/417,246.

*Primary Examiner* — Anne M Kozak
(74) *Attorney, Agent, or Firm* — Hassan Abbas Shakir; Shakir Law PLLC

(57) ABSTRACT

Visor for a protective helmet, having two retaining arms and two bearing devices for the retaining arms which are attached to a helmet shell of a helmet in order to pivot the visor between two end positions corresponding to an operational position and a parked position in which the visor is folded up and is disposed on the outer surface of the helmet shell. The visor is provided with a soft lip, preferably made from TPU or TPE, at the location where it comes into contact with the helmet shell in the end positions. When the visor is manually activated to pivot out of an end position, the visor is accelerated by resilient pretensioning in the direction of the other end position until the lip is in contact with the helmet shell substantially without recoil. The lip damps the movement momentum of the visor and additionally has a sealing function.

13 Claims, 6 Drawing Sheets

(56) References Cited

U.S. PATENT DOCUMENTS

| | | | |
|---|---|---|---|
| 5,084,918 | A | 2/1992 | Breining et al. |
| 5,088,131 | A | 2/1992 | Kamata |
| 6,035,451 | A | 3/2000 | Burns et al. |
| 6,041,435 | A | 3/2000 | Paulson et al. |
| 8,806,667 | B2 | 8/2014 | Pfanner et al. |
| 9,113,671 | B2 | 8/2015 | Pfanner et al. |
| D779,128 | S | 2/2017 | Patel et al. |
| 2006/0080761 | A1 | 4/2006 | Huh |
| 2008/0216215 | A1 | 9/2008 | Lee |
| 2009/0038057 | A1 | 2/2009 | Tews |
| 2009/0300813 | A1 | 12/2009 | Ishikawa |
| 2013/0212787 | A1 | 8/2013 | Pfanner et al. |

FOREIGN PATENT DOCUMENTS

| | | | |
|---|---|---|---|
| CA | 2152845 | A | 12/1995 |
| DE | 29 07 054 | A1 | 9/1979 |
| DE | 26070483 | A1 | 9/1987 |
| DE | 94 10 596 | U1 | 8/1994 |
| DE | 29 70 8134 | U1 | 8/1997 |
| DE | 10 2009 012 450 | A1 | 9/2010 |
| DE | 10 2010 027015.6 | | 1/2012 |
| EP | 1182943 | A1 | 3/2002 |
| EP | 1 841 338 | B1 | 10/2007 |
| WO | 0040978 | | 11/2000 |

(State of the art)

VISOR AND COMBINATION THEREOF WITH A PROTECTIVE HELMET

BACKGROUND OF THE INVENTION

1. Field of the Invention

The invention relates to a visor for a protective helmet, comprising two retaining arms and two bearing devices for the retaining arms, said bearing devices being attachable to a helmet shell of a helmet, for pivoting the visor between two end positions which correspond to an operating position, in which the visor is folded down and rests on a front edge of the helmet shell, and a parking position, in which the visor is folded up and disposed on the outer surface of the helmet shell.

2. Discussion of the Related Art

A similar helmet, known from document EP 1 841 338 B1, is preferably used as a police helmet. When the visor of the helmet is folded up in the parking position, a substantial gap exists between the visor and the helmet outer face. When used in the forest area, such a helmet would have the disadvantage that branches could get caught between the visor and the helmet and pull the helmet from the user's head.

The same problem presumably appears with protective helmets of the kind described in documents DE 94 10 596 U1 and DE 29 70 834 U1, although they are explicitly meant to be suitable for forest or timberland workers. With these known helmets, too, a greater gap between the visor and the outer surface of the helmet shell occurs in the parking position of the visor, allowing branches to get caught on the helmet.

An even bigger problem may arise with a protective helmet of the kind known from document DE 29 07 054 A1 when used in the forest area. Here the visor assumes a parking position in which it has a particularly large distance from a shield-like front edge of the helmet and from the outer face of the helmet at a position which is further up relative to the edge, so that branches cannot get caught only between the visor and the outer face of the helmet shell, but also on the visor itself.

SUMMARY OF THE INVENTION

In order to avoid such problems with a visor of the above-mentioned kind known from document DE 10 2010 027 015 A1, each bearing device is formed for being mounted to the helmet shell inside and each retaining arm extends from the visor to its free end connected to the bearing device substantially parallel to and with such a distance from the visor that a slot is formed between the retaining arm and the visor through which the helmet shell extends in the parking position. Furthermore, the visor is disposed in close adjacency on the outer surface of the helmet shell in the parking position. The visor is guided by the retaining arms so that in the operating position it does hardly have any distance from the outer surface of the helmet with its upper edge. This visor does therefore not offer any opportunities for obstacles to get caught. With this known visor, each of the bearing devices has a spring-biased locking element associated with it by means of which the visor is retained in a releasable manner by frictional force in the operating position and in the parking position. When the visor is manually set into motion, the spring bias of the locking element causes the visor eventually to move into one of the two end positions on its own and with an increasing acceleration. When the visor or a frame of the visor then hits the helmet in the end position, the visor may rebound and come to rest in a position that is not precisely the desired end position. Furthermore, the impact on the helmet shell in the end position is always accompanied by generation of noise, which is usually perceived as annoying.

Known from DE 10 2009 012 450 A1 is a helmet having a visor equipped with a sealing lip which in the operating position rests against the helmet shell.

DE 36 07 483 A1 describes a protective helmet that comprises a folding part and a visor attached to the folding part. In the operating position, the folding part cooperates with the helmet to have a sealing function. In the operating position, the visor cooperates with the folding part to have a sealing function.

It is an object of the invention to design a visor of the above-mentioned type such that it can reach its two end positions safely and substantially silently.

In accordance with the invention, this object is solved by providing the visor with a soft lip at least in an area in which the visor can be brought into close proximity or into touch with a helmet shell in the end positions.

With the visor of the invention, when its soft resilient lip hits the outer surface of the helmet shell in the end position corresponding to the parking position, the lip of the visor damps the momentum of motion so that a rebound is substantially prevented and the noise generated during the impact on the helmet shell is substantially damped. The lip of the visor of the invention has the same effect when the visor in the end position corresponding to the operating position hits the protruding front edge of the helmet shell from above, wherein the sealing lip in this position additionally also provides a seal between the visor and the helmet shell so that raindrops pouring down on the outer surface of the helmet shell pour down aside via the visor toward the outside and thus do not enter the field of view of the person wearing the helmet. In the end position corresponding to the parking position, the lip of the visor has the same sealing effect. Furthermore, in the parking position a view screen or a grid mesh in the frame of the visor provides a rain shield which does not allow raindrops to enter the field of view immediately.

In accordance with the invention, the lip of the visor is a soft component, in contrast to a hard component formed by the view screen or the frame of the visor. The soft component is resilient and prevents the hard component from rebounding from the desired end position. With a protective helmet in which the visor freely swings from one of the end positions to the other one due to a spring bias generated in the bearing device as soon as this motion has been initiated by hand, the soft lip damps the closing momentum. This is significant in particular for a visor with a protective helmet where the visor always has a minimum distance from the outer surface of the helmet shell in both end positions and in the range between the two end positions.

The lip is formed and disposed on the visor such that in the operating position of the visor it can be placed onto a protruding front edge of the helmet shell. This does not only ensure good damping while assuming the end position corresponding to the operating position, but also ensures a particularly good seal between the visor and the helmet shell in this end position.

Advantageous embodiments of the visor of the invention are the subjects of the dependent claims.

In an embodiment of the visor of the invention, the lip is further formed and disposed on the visor so that it can be brought to rest against the outer surface of the helmet shell in the parking position. This close adjacency is beneficial for both the damping and the sealing function of the lip and ensures that the visor assumes and also retains each of the two desired end positions.

In a further embodiment of the visor of the invention, the lip is made of a soft resilient material which is shock absorbing as well as sealing, wherein in a further embodiment the material of the lip is preferably selectable among rubber, TPE, TPU, silicon rubber, PVC, or the like. Selection of a suitable material for the lip thus allows influencing its damping and sealing function.

In a further embodiment of the visor of the invention, the lip is attached to the visor or to a visor frame by frictional force. For this purpose, the lip may have a suitable profile, for example, substantially a U-profile, allowing it to be easily plugged onto a corresponding ledge of the visor or a frame of the visor.

In a further embodiment of the visor of the invention, the lip is attached to the visor or to a visor frame by form fit and/or adhesion. The connection by form fit can be achieved, for example, by providing the sealing lip at its free longitudinal edges with bulges which engage in a corresponding notch on the visor or on the visor frame in a manner similar to a bulge stripe engaging in a bulge rim. Alternatively or in addition, a connection by adhesion can be achieved when establishing the connection of the lip with a visor or a visor frame, which is usually done during a spraying process, by welding or melting the lip with the material of the visor or the visor frame.

In a further embodiment of the visor of the invention, at least one of its bearing devices has a spring-biased end position lock associated with it which locks the support arm in each end position by frictional force and which accelerates the visor toward the other end position when pivot motion of the visor out of an end position is manually initiated, until the lip touches the helmet shell substantially without a rebound. This end position lock, which by itself is known, and the acceleration by the end position lock during the pivot motion between the two end positions, which by itself is known, are supplemented in accordance with the invention by the damping and sealing function of the lip, which facilitates assuming and retaining each end position.

In a further embodiment of the visor of the invention, the visor is combined with a protective helmet. Although the latter may be a protective helmet in which the visor is moved into the one or the other end position by hand, the visor of the invention has a particularly advantageous effect in the combination according to the invention if it is moved between its two end positions under spring bias, because it is capable of preventing a rebound by damping the momentum of motion when reaching the end of the pivot motion and, simultaneously, of damping generation of noise and, in addition, of having a sealing function.

BRIEF DESCRIPTION OF THE DRAWINGS

Examples of embodiments of the invention are further described below with reference to the drawings.

DETAILED DESCRIPTION OF THE INVENTION

Figure 1:
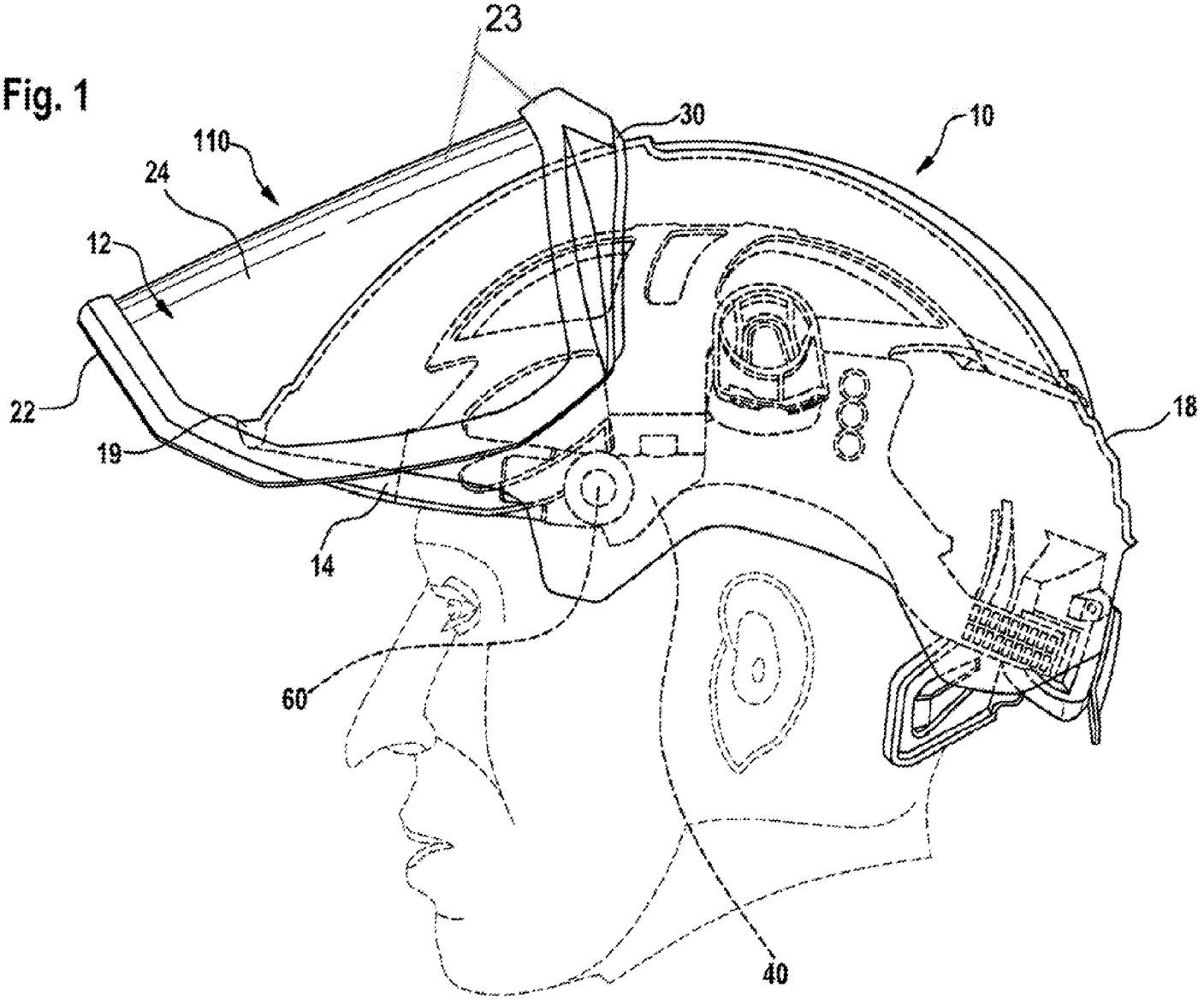
FIG. 1 shows a side view of a visor of the invention on a protective helmet, in particular for forest workers, wherein the visor is shown folded up in a parking position.

In the drawings, a protective helmet collectively denoted 10 is shown in an embodiment destined in particular for use in the forest industry. The protective helmet 10 comprises a face protection collectively denoted 110 with a visor 12 of the invention, which is shown folded up in an end position corresponding to a parking position in FIG. 1 and folded down in another end position corresponding to an operating position in FIG. 2. Bearing devices 40 of the face protection 110 are formed identically in symmetrical fashion on both sides of the helmet 10. Therefore, no difference is made in the following description between right and left bearing devices, support joints, retaining arms, and so on.

Figure 2:
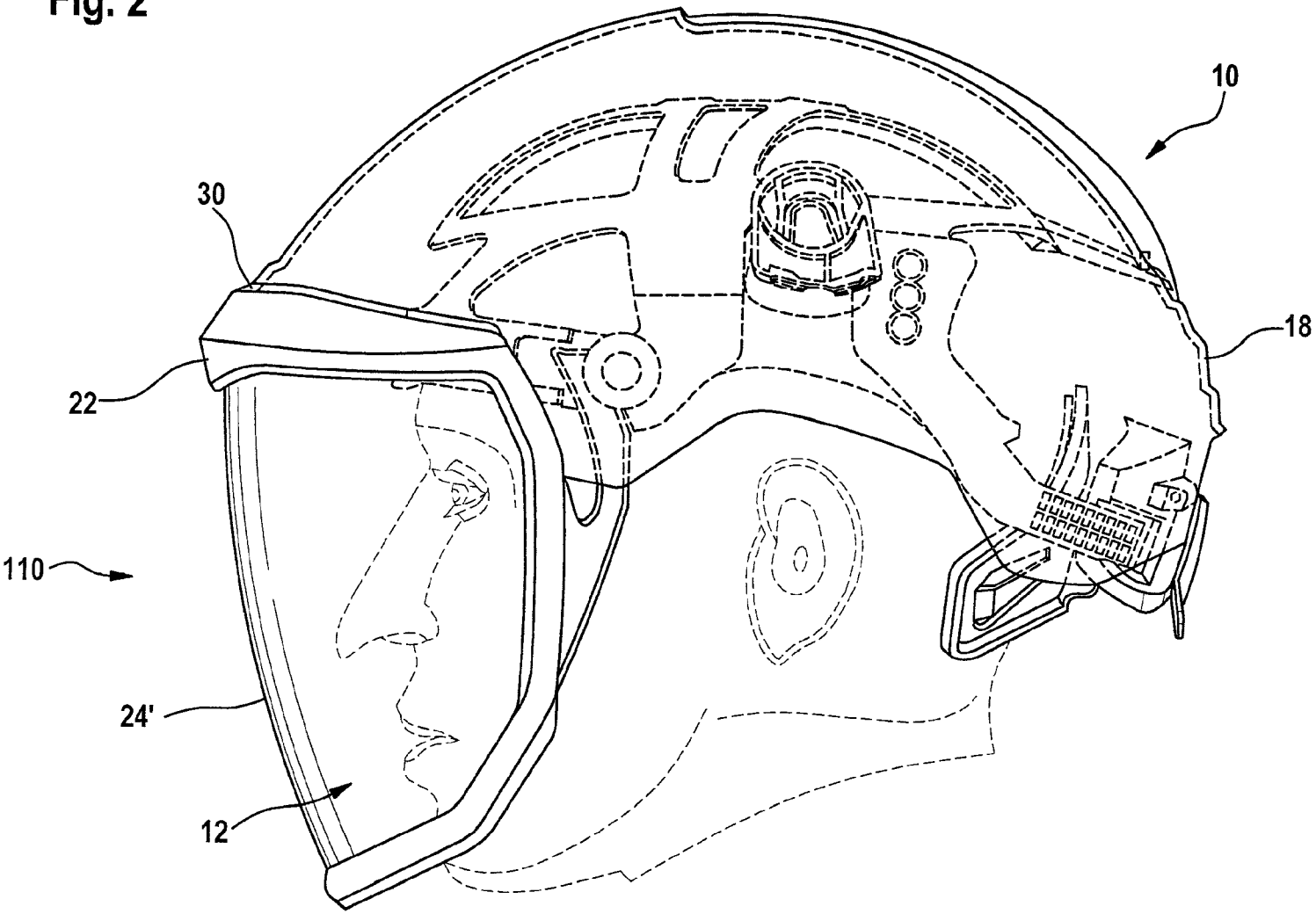
FIG. 2 shows the protective helmet in the same side view as in FIG. 1, wherein the visor is folded down in an operating position and wherein the protective helmet additionally carries a hearing protection not shown in FIG. 1.
Figure 3:
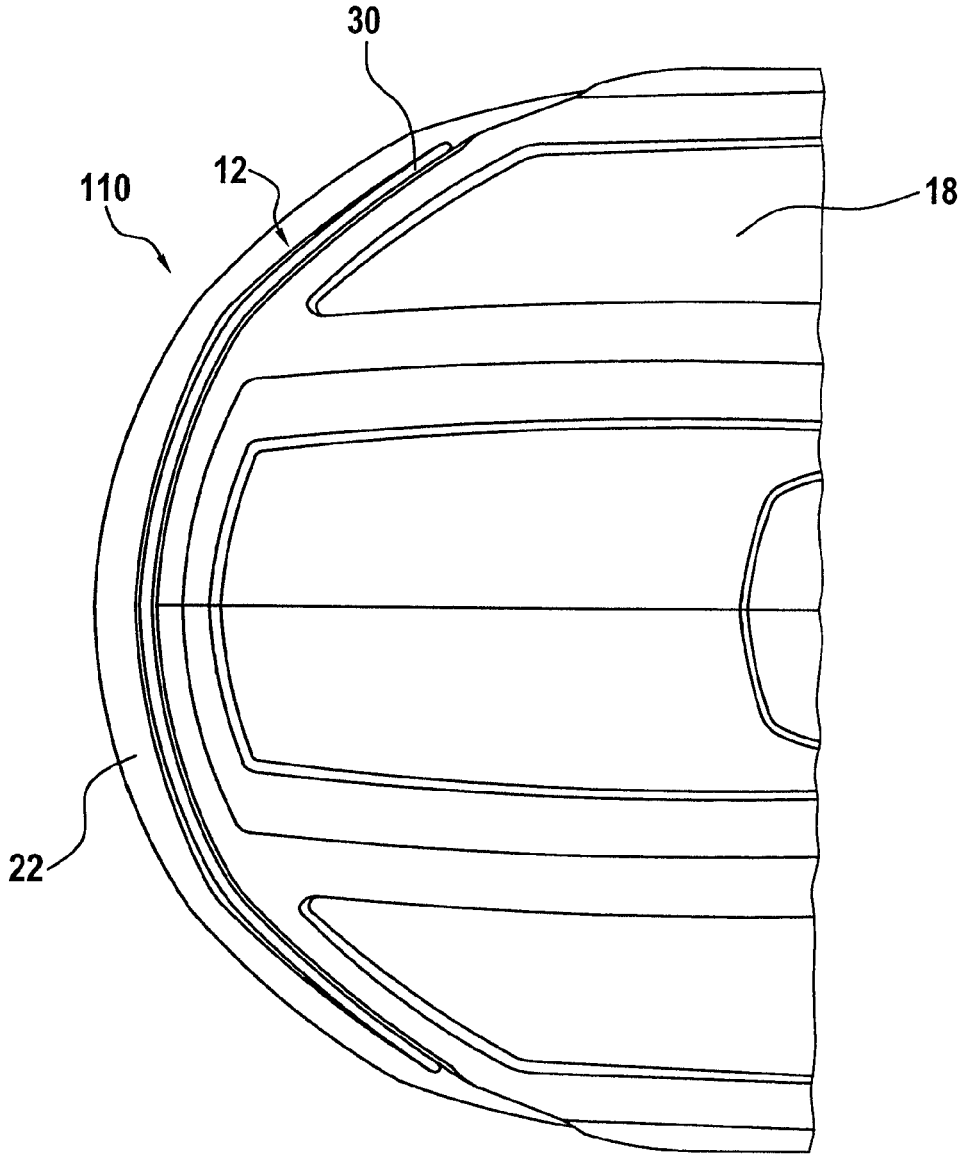
FIG. 3 shows a top view of a front half of the protective helmet of FIG. 2.

The visor 12 of the face protection 110 comprises, on each side of the helmet 10, a retaining arm 14 and the bearing device 40, which is formed as a plug and on which a part of a support joint is formed. The bearing device 40 of each retaining arm 14 is attachable at the inner face of a helmet shell 18. Each bearing device 40 is formed as a part of a two-piece plug coupling, which part can be plugged onto the other part of the plug coupling which is mounted inside on the helmet shell 18. Said other part of the plug coupling is not shown in FIGS. 1 and 2. It consists of several rod-like protrusions formed on the inner face of the helmet shell 18. The bearing device 40 is plugged onto the rod-like protrusions whereby the support joint 16 of the visor 12 comes to rest at the inner face of the helmet shell 18 in each temper region. In FIGS. 1 and 2, the bearing device 40 can be seen attached inside to the helmet shell 18.

The retaining arm 14 is formed at one end against the back side of a frame 22 of the visor 12. At the free end of the retaining arm 14, the support joint 16 is formed. The following structure of the bearing device 40 and the support joint 16 is known from the above-mentioned document DE 10 2010 027 015 A1 from which claim 1 starts in its generic expression. Each bearing device 40 comprises a spring-biased locking element, which is also known from the above-mentioned document and which does not need to be described any further. The locking element can be taken along when folding the visor 12 up and down to retain the visor 12 in its one or other end position releasably by frictional force.

Figure 6:
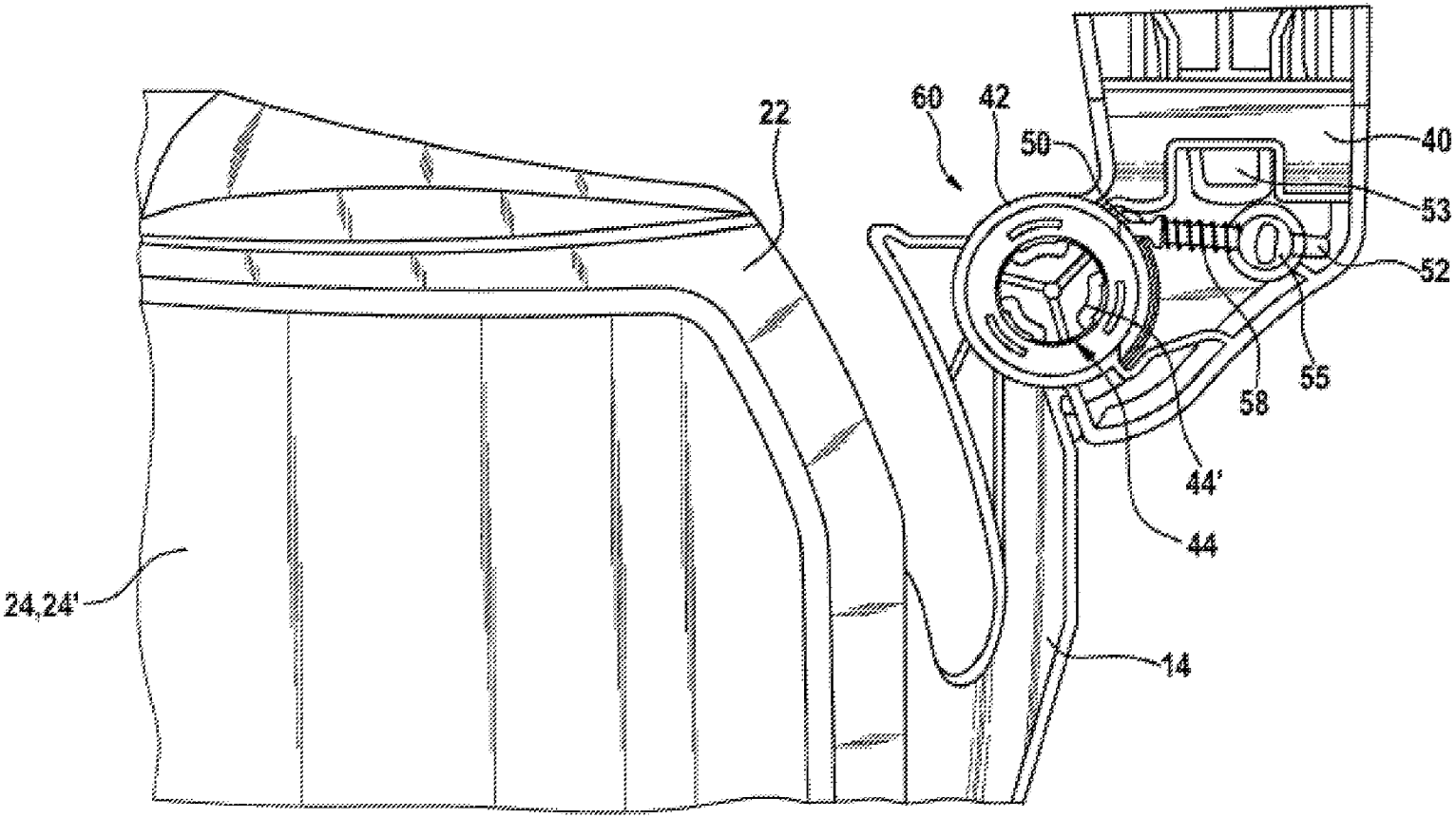
FIG. 6 shows, as a detail, a support joint which connects a support arm of the visor and a bearing device to each other, wherein the visor is shown folded down in an end position corresponding to the operating position.

At least one of the bearing devices 40 of the visor 12 is provided with a spring-biased end position lock which locks the retaining arm 14 in each end position by frictional force and which biases the visor 12 toward the other end position when the pivot motion of the visor 12 out of an end position is initiated manually. This is described in greater detail considering the example of a bearing device 40 as shown in FIG. 6 and as known from the above-mentioned document DE 10 2010 027 015 A1.

At the free end of the retaining arm 14, a ring bearing bushing 42 is formed. Each bearing device 40 comprises a bearing pivot 44 for receiving the ring bearing bushing 42. Each bearing device 40 is formed as a plug or part of an already mentioned plug coupling, which plug or part can be plugged onto the other part of the plug coupling which is mounted inside on the helmet shell 18. The bearing pivot 44 of each plug coupling part comprises axially protruding resiliently flexible tappets 44' on which the ring bearing bushing 42 can be snapped.

A spring-biased locking element 50 forms an end position lock, engages in the ring bearing bushing 42 from outside, and can be taken by the ring bearing bushing 42 when the visor 12 is folded up and down to retain the visor 12 in its one or other position releasably by frictional force. One of the two positions of the spring-biased locking element 50 is shown in FIG. 6, in which the visor 12 is in the operating position. The spring-biased locking element 50 comprises a roller rotatably supported at one end of a rod 52, wherein the other end of the rod 52 extends slideably through a pivot bearing 55 and wherein a pressure spring 58 rests against the rod 52 between the pivot bearing 55 and a shoulder to generate the spring bias. When the pivot motion of the visor 12 out of an end position is manually initiated, the visor 12 is biased toward the other end position by the locking element 50 forming an end position lock.

The visor 12 is provided with a soft resilient lip 30 at least in a region in which it can be brought into close proximity or into touch with the helmet shell 18 in the end positions. The frame 22 and the actual face protection, for example, a clear view screen or fine-meshed metal grid 24, form a face protector 23.

The frame 22 of the visor 12 encloses the actual face protection, which is a clear-view screen or a fine-meshed metal grid 24, for instance as known from document EP 1 182 943 B1. The frame 22 consists of a hard stiff plastic but it could easily consist of aluminum or the like instead. The visor 12 could also consist of a frameless clear-view screen with retaining arms or of a frame provided with retaining arms which encloses and supports a clear-view screen or a protective grid.

Figure 4:
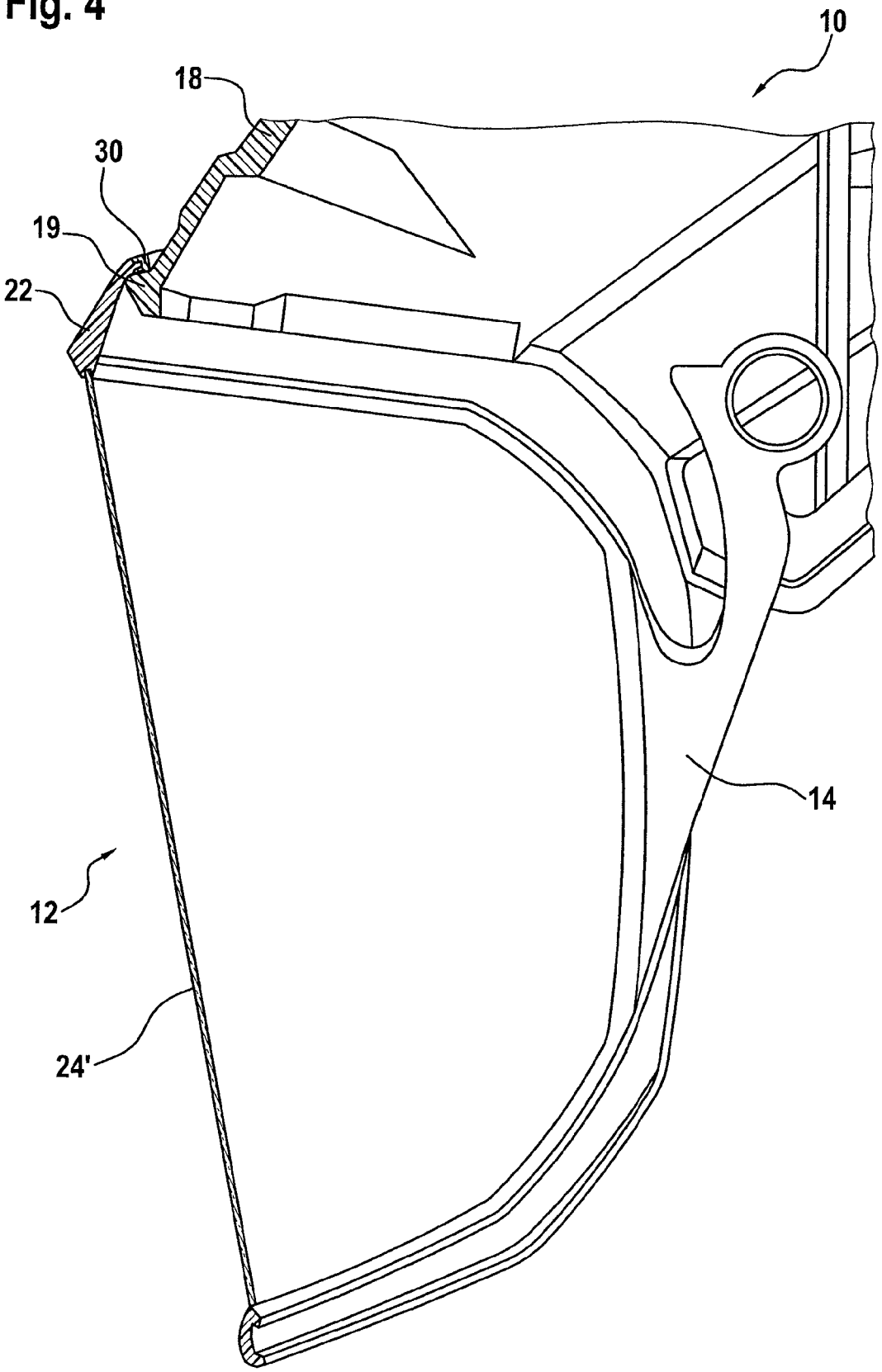
FIG. 4 shows the visor and a front part of the protective helmet as a detail in a sectional view.
Figure 5:
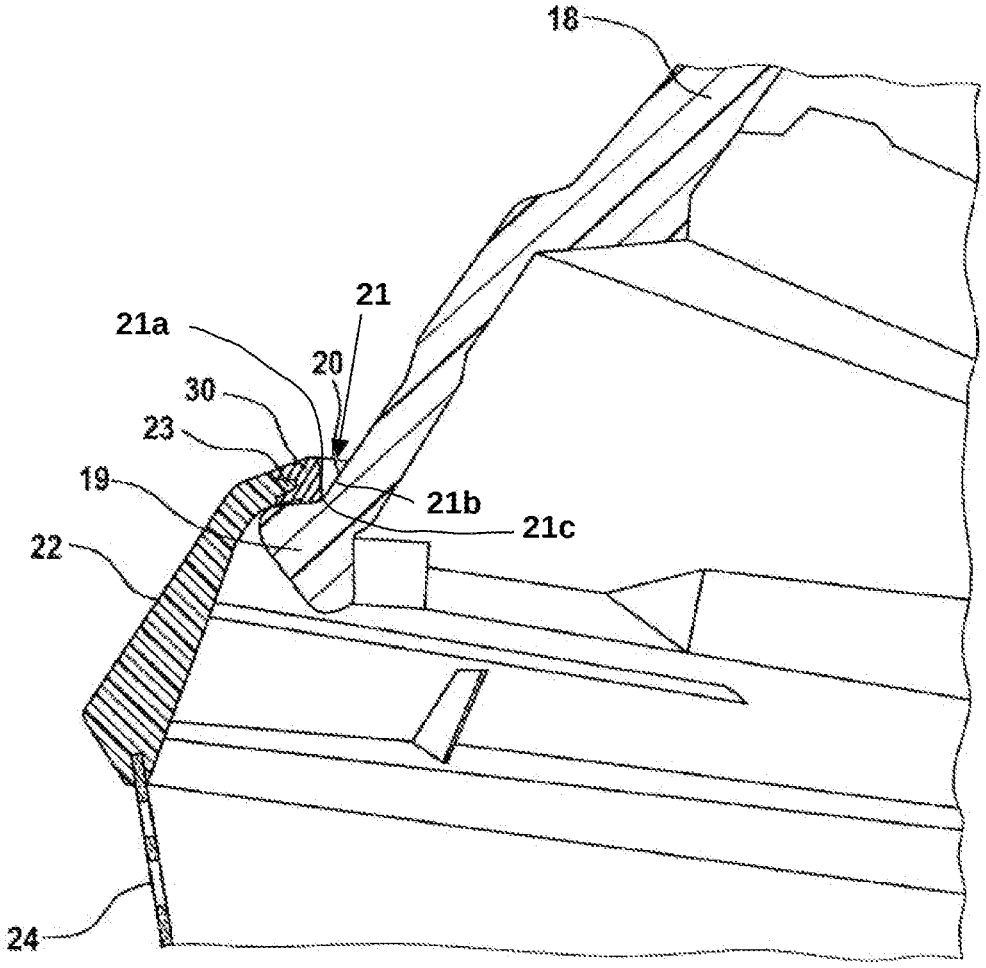
FIG. 5 shows a part of the detail of FIG. 4 on a greater scale.

The lip 30 is formed and disposed on the frame 22 of the visor 12 so that in the operating position according to FIGS. 2, 4, and 5 of the visor 12 it can be placed onto a protruding front edge 19 of the helmet shell 18 and/or against an adjacent edge region 20 of the outer surface of the helmet shell 18. While the frame of the known helmet according to the above-mentioned document DE 10 2010 027 015 A1, from which the generic expression of claim 1 starts, can also rest upon the front edge of the helmet shell, that front edge corresponds to an edge region 20 shown in FIG. 5, since the helmet shell of the known protective helmet does not have a protruding front edge like the protruding front edge 19 of the helmet shell 18 of the protective helmet 10 shown and described here.

Furthermore, the lip 30 is formed and disposed on the visor 12 so that in the parking position according to FIG. 1, it rests or can be brought to rest against the outer surface of the helmet shell 18 at the top. Here it is shown that it rests against the outer surface of the helmet shell 18 at the top.

The lip 30 is made of a soft resilient material which is shock absorbing as well as sealing. The material of the lip 30 can be selected among rubber, TPU (thermoplastic polyurethane), TPE (thermoplastic elastomers), silicon rubber, PVC, and the like. Preferably, the lip 30 consists of rubber, TPU, or TPE.

In the example of an embodiment shown and described here, the lip 30 is attached to the frame 22 of the visor by form fit and by adhesion. Instead, it could be attached to the frame merely by frictional force. For this purpose, the frame 22 is provided with a protruding edge 23 which engages in a complementary notch formed in the lip 30. In addition, the lip 30 can be glued or welded with the frame 22. Preferably, the lip 30 is sprayed to the frame 22 which is sprayed or has been sprayed around the metal grid 24.

The combination of the visor 12 with a protective helmet like the protective helmet 10, which has the protruding front edge 19 in a front region, enables the visor 12 to have its effect and to have its damping and sealing function.

The notch of lip 30 is in a first surface. A second surface of lip 30 is opposite the first surface. The second surface and the outer surface of helmet shell 18 define a channel 21 directing water away from the face of the user. Channel 21 having a cross-sectional shape of two straight lines 21*a*, 21*b* extending upward from a point 21*c*.

LIST OF REFERENCE SYMBOLS

10 protective helmet
12 visor
14 retaining arm
16 support joint
18 helmet shell
19 front edge
20 edge region
22 frame
23 ledge
24 metal grid
24' clear-view screen
30 lip
40 bearing device
42 ring bearing bushing
44 bearing pivot
44' tappet
50 locking element
52 rod
53 resilient finger
55 pivot bearing
58 pressure spring
60 support joint
110 face protection

The invention claimed is:

1. A helmet for protecting a face of a user, the helmet comprising:

a helmet shell comprising a downsloping front region defined by a front edge and an outer surface;

a visor comprising a face protector movable between an operating position and a parking position, the operating position being where the face protector is folded down and rests on the front edge and the parking position being where the face protector is folded up and disposed at the outer surface;

two bearing devices, each bearing device being attached to the helmet shell of the helmet, each bearing device associated with a respective retaining arm for pivoting the face protector between the operating position and the parking position;

a soft lip disposed at an upper edge of the face protector, the soft lip when in the parking position sealing the face protector to the outer surface of the helmet shell to prevent water from migrating to the face of the user; and a frame of the face protector, the frame comprising a protruding edge and the soft lip comprises a receiving notch in a first surface fro receiving the protruding edge for attaching the soft lip to the frame;

wherein each bearing device is formed as a part of a two-piece plug coupling, a first coupling piece configured to be plugged onto a second coupling piece which is mounted inside the helmet shell;

wherein a second surface of the soft lip is opposite the first surface of the soft lip, the second surface of the soft lip and an outer surface of the helmet shell define a channel directing water away from the face of the user, the channel comprising a cross-sectional shape of two straight lines extending upward from a point.

2. The helmet of claim 1, wherein at least one bearing device of the two bearing devices comprises a spring-biased end position lock, the lock for locking the retaining arm in one of the positions by frictional force, and wherein, when a pivot motion of the face protector out of the operating position is manually initiated, the lock accelerates the face protector toward the parking position until the soft lip touches the helmet shell without a rebound.

3. The helmet of claim 1, wherein the soft lip comprises a soft resilient material, the material being shock absorbing and sealing.

4. The helmet of claim 3, wherein the material is selected from the group consisting of rubber, thermoplastic polyurethane, thermoplastic elastomers, silicon rubber, or polyvinyl chloride.

5. The helmet of claim 1, wherein the soft lip is attached to the face protector or to frame of the face protector by a frictional force.

6. The helmet of claim 1, wherein the soft lip is attached to the face protector or to the frame of the face protector by form fit or by adhesion.

7. A visor in combination with a helmet shell, the visor for protecting a face of a user, the combination comprising:

a helmet shell comprising a downsloping front region defined by a front edge and an outer surface;

a visor comprising a face protector movable between an operating position and a parking position, the operating position being where the face protector is folded down and rests on the front edge and the parking position being where the face protector is folded up and disposed at the outer surface;

two bearing devices, each bearing device being attached to the helmet shell of the helmet, each bearing device associated with a respective retaining arm for pivoting the face protector between the operating position and the parking position;

a soft lip disposed at an upper edge of the face protector, the soft lip when in the parking position sealing the face protector to the outer surface of the helmet shell to prevent water from migrating to the face of the user; and a frame of the face protector, the frame comprising a protruding edge and the soft lip comprises a receiving notch in a first surface for receiving the protruding edge for attaching the soft lip to the frame;

wherein each bearing device is formed as a part of a two-piece plug coupling, a first coupling piece configured to be plugged onto a second coupling piece which is mounted inside the helmet shell; and wherein a second surface of the soft lip is opposite the first surface of the second surface of the soft lip and an outer surface of the helmet shell define a channel directing water away from the face of the user, the channel comprising a cross-sectional shape of two straight lines extending upward from a point.

8. The combination of claim 7, wherein the soft lip comprises a soft resilient material, the material being shock absorbing and sealing.

9. The combination of claim 8, wherein the material is selected from the group consisting of rubber, thermoplastic polyurethane, thermoplastic elastomers, silicon rubber, or polyvinyl chloride.

10. The combination of claim 7, wherein the soft lip is attached to the face protector or to the frame of the face protector by a frictional force.

11. The combination of claim 7, wherein the soft lip is attached to the face protector or to the frame of the face protector by form fit.

12. The combination of claim 7, wherein the soft lip is attached to the face protector or to the frame of the face protector by adhesion.

13. The combination of claim 7, wherein at least one bearing device of the two bearing devices comprises a spring-biased end position lock, the lock for locking the retaining arm in one of the positions by frictional force, and wherein, when a pivot motion of the face protector out of the operating position is manually initiated, the lock accelerates the face protector toward the parking position until the soft lip touches the helmet shell without a rebound.

* * * * *